United States Patent [19]

Golla

[11] Patent Number: 4,514,873

[45] Date of Patent: May 7, 1985

[54] EQUIPMENT FOR CLEANING REMNANTS OF CARBON BLOCKS

[75] Inventor: Franz Golla, Lünen, Fed. Rep. of Germany

[73] Assignee: Gewerkschaft Eisenhutte Westfalia, Lünen, Fed. Rep. of Germany

[21] Appl. No.: 551,166

[22] Filed: Nov. 14, 1983

[30] Foreign Application Priority Data

Nov. 16, 1982 [DE] Fed. Rep. of Germany ..... 3242285

[51] Int. Cl.[3] ..... B08B 1/02

[52] U.S. Cl. ..... 15/306 B; 15/308; 15/345

[58] Field of Search ..... 15/89, 91, 93 R, 308, 15/306 B, 4; 198/345, 680; 125/23 R, 26; 414/743, 744, 590

[56] References Cited

U.S. PATENT DOCUMENTS

| | | | |
|---|---|---|---|
| 1,227,244 | 5/1917 | Buhles | 198/22 X |
| 1,622,869 | 3/1927 | Grant et al. | 15/93 R |
| 1,915,751 | 6/1933 | Noble et al. | 15/93 R |
| 3,373,552 | 3/1968 | Scherr | 57/56 |
| 4,217,000 | 8/1980 | Watanabe | 125/23 R X |
| 4,418,435 | 12/1983 | Arnold | 15/4 |

FOREIGN PATENT DOCUMENTS

| | | | |
|---|---|---|---|
| 2903186 | 2/1979 | Fed. Rep. of Germany . | |
| 937287 | 3/1948 | France | 15/93 R |
| 70648 | 6/1979 | Japan . | |

*Primary Examiner*—Chris K. Moore
*Attorney, Agent, or Firm*—Maurice E. Gauthier

[57] ABSTRACT

Apparatus for cleaning bar-mounted remnants of carbon blocks includes a machining station defining a working position. A breaking device is provided for loosening incrustations adhering to the remnants at the working position. The individual remnants are moved into the working position by a lifting table. The breaking device is constituted by two blades which are displaceable transversely of the direction of movement of the lifting table. An overhead conveyor is provided for moving the remnants into the machining station.

23 Claims, 2 Drawing Figures

EQUIPMENT FOR CLEANING REMNANTS OF CARBON BLOCKS

BACKGROUND TO THE INVENTION

The invention relates to apparatus for cleaning bar-mounted remnants of carbon blocks, particularly anode blocks.

As is well known, the used-up carbon anodes (anode remnants as they are called) that occur in, for example, the electrolytic extraction of aluminium, become coated with relatively thick incrustations consisting of a mixture of aluminium oxide and solidified material from the melt. For reasons of economy, it is necessary to remove these incrustations from the anode remnants, so that they can be recycled for use in the electrolysis process, and so that the anode remnants can be used for producing new carbon anodes. In practice, the cleaning of the anode remnants is still mainly carried out manually by using tools such as air lances.

DE-OS No. 3 032 525 describes a system for cleaning anode remnants by mechanical means. In that system, use is made of a carriage having a pallet for conveying the bar-mounted anode remnants. An anode remnant to be cleaned is positioned on the pallet in an upright position using a device such as a hoisting tackle. The remnant is then firmly clamped to the pallet using a clamping device arranged on a travelling table. The travelling table, the pallet, and the clamped anode remnant are tilted through 90° to position the remnant horizontally. The remnant is then moved into a working position at a region beneath a breaking tool, by means of which the incrustations are broken away. The broken-away material falls into a funnel, and is carried away on a conveyor. After the breaking operation, the pallet and the cleaned anode remnant are swung back, and are deposited on the carriage.

The aim of the invention is to provide a simplified apparatus for cleaning bar-mounted remnants of carbon blocks.

SUMMARY OF THE INVENTION

The present invention provides apparatus for cleaning bar-mounted remnants of carbon blocks, the apparatus comprising a machining station defining a working position, a breaking device for loosening incrustations adhering to the remnants at the working position, and a transport device for moving the individual remnants into the working position, wherein the breaking device is constituted by at least one breaking tool which is displaceable transversely of the direction of movement of the transport device.

This apparatus requires the least possible space for its operation and accommodation, and is such that the remnants can be reliably cleaned in a rapid sequence, without it being necessary to move the remnants from a clamping position into a cleaning position (or to return them from a cleaning position to a clamping position), so that repeated transfer movements are avoided.

The apparatus may further comprise a conveyor for moving the remnants successively to the machining station. Advantageously, the conveyor is an overhead conveyor such as a travelling crane or an overhead rail track.

In a preferred embodiment, the transport device is a lifting device, preferably a lifting table. The lifting table is such that a remnant can be brought into a predetermined position in relation to the breaking device, so that the incrustations can be removed by the breaking device exactly along the line dividing the incrustations from the surface of the remnant. The overhead conveyor can carry the remnants, in a suspended position, into the machining station. The lifting table can then be raised, from below, towards the remnants. Further movement of the lifting table raises the remnants to the working position in which the incrustations are removed while the remnants are supported on the lifting table. This can be achieved without separating the remnants from the overhead conveyor. The cleaned remnants can then be carried away from the machining station by the overhead conveyor. The distance through which each remnant is raised by the lifting table is dependent upon the thickness of that remnant, and can be readily controlled in such a way that practically complete removal of the incrustations is achieved.

Advantageously, the lifting table is arranged on an arm, the arm being mounted on a stand for vertical displacement relative thereto. Preferably, the lifting table is mounted on the arm so as to be pivotable about a horizontal axis, and the arm is mounted on the stand so as to be pivotable about a vertical axis. By tilting the lifting table, or by swinging it out to the side, any material that may have found its way on to the table during the breaking operation can be cleared off, for example, into a receiving container or on to a conveyor. In this case, it is advantageous to provide a special conveyor, the conveyor being positioned below the lifting table for carrying away material broken away from the remnants.

In a preferred embodiment, the apparatus further comprises a retaining device for holding individual remnants in the machining station in alignment with the working position. Advantageously, the retaining device retains and aligns the individual remnants by abutment with their rods. Conveniently, the retaining device is constituted by a forked member. Preferably, the retaining device is pivotally mounted for movement about a horizontal axis, a ram being provided for pivoting the retaining device.

The cleaning apparatus defined above offers the possibility of at least partially (or even completely) automating the operating cycle during the cleaning operation, without over-complication of its control means. In this connection, a limit switch may be provided, the limit switch being arranged to stop the movement of the transport device when an individual remnant is in the working position. Advantageously, the limit switch is so positioned as to be actuated by nipples associated with the rods of the remnants. The remnants to be cleaned can be exactly aligned with the breaking device with the aid of the limit switch. At the same time, the breaking device can be controlled using the limit switch.

The breaking device is such that the incrustations can be removed from the remnants in one operation only. For this puspose, the breaking device is advantageously constituted by two blades. Preferably, each of the blades is pivotable about an axis which is parallel to the direction of movement of the transport device, and each of the blades is pivotable by means of a ram, the arrangement being such that the blades move in the manner of tongs. Each of the blades may be of shovel-shaped configuration, and each blade may have a cutting edge provided with at least one recess.

The apparatus may further comprise a blower and a suction device, the blower being positioned in the zone of the breaking device, and the suction device being positioned in the path of dust blown off by the blower.

The invention also provides apparatus for cleaning bar-mounted remnants of carbon blocks, each of the remnants being mounted on nipples provided at the end of a bar, the apparatus comprising a breaking device for loosening incrustations adhering to the remnants, the breaking device being constituted by two blades, each of the blades having a cutting edge provided with at least one recess, the blades being movable in such a manner, and the recesses being so positioned, that, in use, the recesses engage around the nipples of said bars.

BRIEF DESCRIPTION OF THE DRAWINGS

Apparatus for cleaning anode block remnants, and constructed in accordance with the invention, will now be described, by way of example, with reference to the accompanying drawings, in which.

DESCRIPTION OF PREFERRED EMBODIMENT

Figure 1:
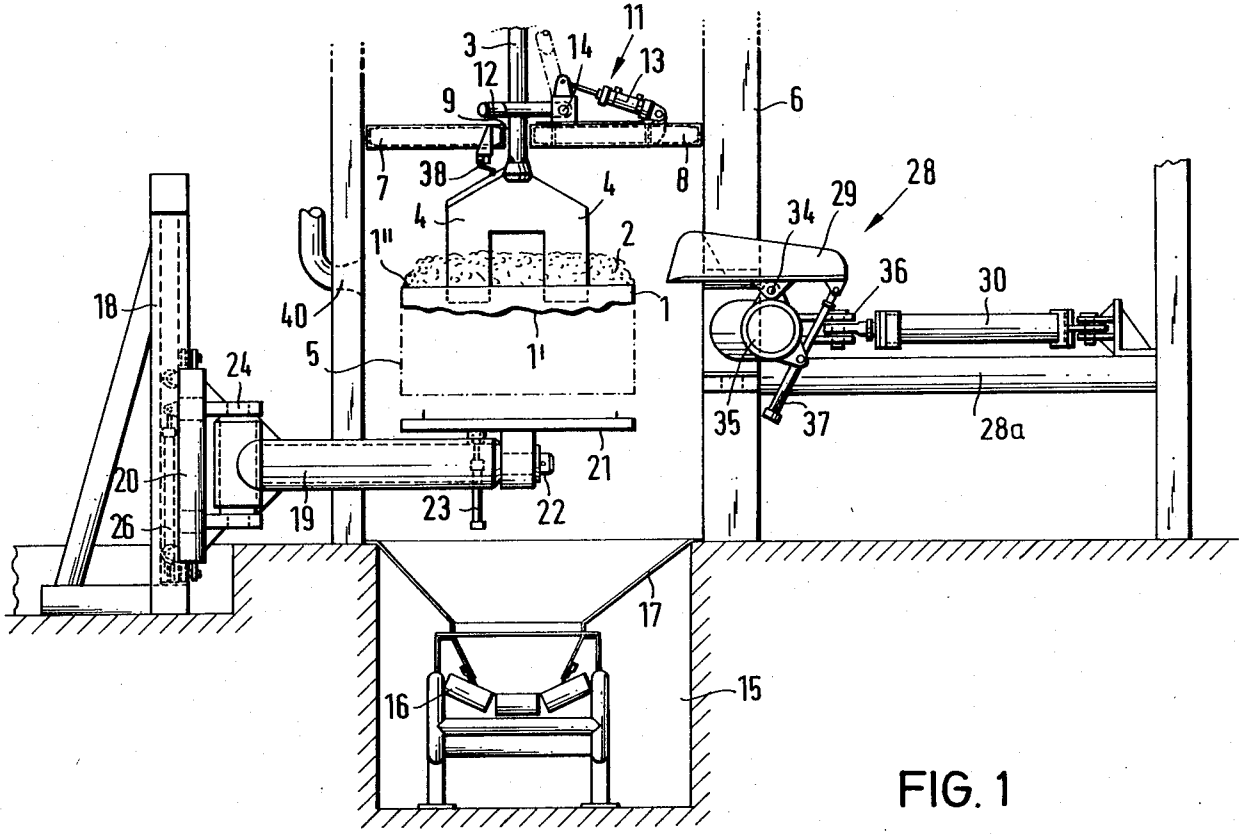
FIG. 1 is a side elevation of the cleaning apparatus.

Referring to the drawings, FIG. 1 shows apparatus for cleaning remnants 1 of carbon anode blocks. The upper face of the remnants 1 is coated with incrustations 2 which have built up as a result of the carbon blocks having been used in an aluminium electrolytic smelting plant. The incrustations 2 are a mixture of aluminium oxide and solidified material from the melt. Each remnant 1 is arranged on an anode bar 3, the anode bar having nipples 4 for retaining the remnant. The original shape of an anode block is shown in dot-dash lines 5 in FIG. 1.

The cleaning apparatus has a frame 6 which supports a pair of horizontal guide plates 7 and 8. A guide slot 9 is formed between the guide plates 7 and 8, the ends of the guide slot constituting flared mouth portions 10. The remnants 1 that are to be cleaned are carried to the apparatus, one by one, by means of an overhead conveyor (not shown) such as a travelling crane or an overhead rail track. This conveyor is arranged on the upper part of the frame 6. As a remnant 1 is moved into position, its anode bar 3 moves through the guide slot 9.

A retaining and alignment device 11 is arranged on the guide plate 8. This device 11 is constituted by a fork 12 which is mounted on the guide plate 8 for pivotal movement about a horizontal axis 14. The fork 12 is pivotable, by means of a ram 13, between a raised position (shown in dash-dot lines in FIG. 1), and a lowered, working position (shown in full lines in FIG. 1). With the fork 12 in its working position, the anode bar 3 of a given remnant 1 lies between the cheeks of the fork. Thus as each of the remnants 1 is positioned within the cleaning apparatus, its anode bar is held within the fork 12, which thereby prevents that remnant from tilting or moving laterally.

A duct 15 is arranged beneath the frame 6, the duct containing a conveyor 16 and a funnel 17. The conveyor 16 is a belt conveyor, and serves to carry away the material broken away from the remnants 1.

A stand 18 is arranged at one side of the frame 6. The stand 18 has a lifting arm 19 provided on a slide 20, the slide being vertically displaceable relative to the stand by means of a ram 26. The ram 26 is braced against the stand 18, and engages the slide 20. The free end of the lifting arm 19 carries a lifting table 21. The lifting table 21 is disposed above the conveyor 16. The lifting table 21 is pivotally mounted on the arm 19 about a horizontal shaft 22 whose axis coincides with the central longitudinal axis of the arm. A ram 23 is arranged between the arm 19 and the lifting table 21, the ram 23 being effective to tilt the table 21 about the shaft 22. The arm 19 can also be pivoted about a vertical shaft 24, this being achieved by means of a ram 25. Thus, the lifting table 21 can be raised and lowered in the vertical direction, can be pivoted about the horizontal shaft 22, and can be pivoted laterally on the stand 18 about the vertical shaft 24.

A breaking device 28 is mounted on the frame 6, at the opposite side to the stand 18, by means of a cross-piece 28*a*. The device 28 has two shovel-shaped blades 29, each of which is pivotally attached to a bracket 28*b* fixed to the cross-piece 28*a*, the blades being pivotable about vertical shafts 31 by means of double-acting rams 30. The blades 29 each have three cutting edges 32, between adjacent pairs of which are recesses 33. Each of the blades 29 can be pivoted about a respective horizontal shaft 34 mounted on a respective carrier 35 by means of a respective ram 37. Each carrier 35 is pivotally attached to the associated ram 30 by a respective pivot joint 36. Thus, the blades 29 can be pivoted, by their rams 30, about the pivot joints 36 in the manner of tongs.

In use, anode block remnants 1 that are to be cleaned are fed to the apparatus in succession by means of the overhead conveyor. Each remnant 1 is fed, by one of the flared mouth portions 10, into the guide slot 9. It is then carried into alignment with the fork 12 (see FIG. 1), which is then swung down to hold the anode bar 3 of the remnant in position. The lifting table 21 is then raised by means of the ram 26. As this happens, the lifting table 21 strikes the lower side 1′ of the remnant 1 to lift that remnant, together with its anode bar 3, into a position (the working position) in which the upper face 1″ of the remnant is located in the operating plane of the blades 29. Irrespective of the thickness of the remnant 1, this working position is determined by a limit switch 38 provided on the lower face of the guide plate 7. Thus, as the remnant 1 moves upwards, the upper face of one of the anode nipples 4 of the anode bar 3 strikes the limit switch 38, so that this switches off the ram 26. The limit switch 38 is so positioned that, when it is actuated, the upper face 1″ of a remnant 1 is located exactly in the working plane of the blades 29. The remnant 1 is supported by the lifting table 21 in the working position. The rams 30 of the breaking device 28 are then extended, so that the blades 29 are swung towards one another about their shafts 31, and close in the manner of tongs. This results in the incrustations 2 being separated from the remnant 1 by the blades 29 precisely along the line dividing the incrustations from the remnant. The positions and dimensions of the recesses 33 between the cutting edges 32 are so selected that the nipples 4 of the associated anode bar lie in the recesses 33 as the blades close. Consequently, the nipples 4 are not damaged by the blades 29.

During breaking, at least the major part of the broken-away material remains on the shovel-like blades 29. The blades 29 are then tilted about their shafts 34, by means of the rams 37, so that this material is dropped onto the conveyor 16 by way of the funnel 17. Any broken-away material that may be on the lifting table 21 can likewise be dropped onto the conveyor 16, by tilting the lifting table about the shaft 22 by means of the ram 23. Alternatively, the lifting table 21 can be swung out of the frame 6 by pivoting the lifting arm 19 about the swivel shaft 24. The material lying on the lifting table 21 can then be dropped into a separate container or onto a separate conveyor (not shown) by tilting the lifting table. This alternative is particularly useful when pieces of carbon, that can be used again, are broken away with the incrustations 2 and are located on the lifting table 21.

Figure 2:
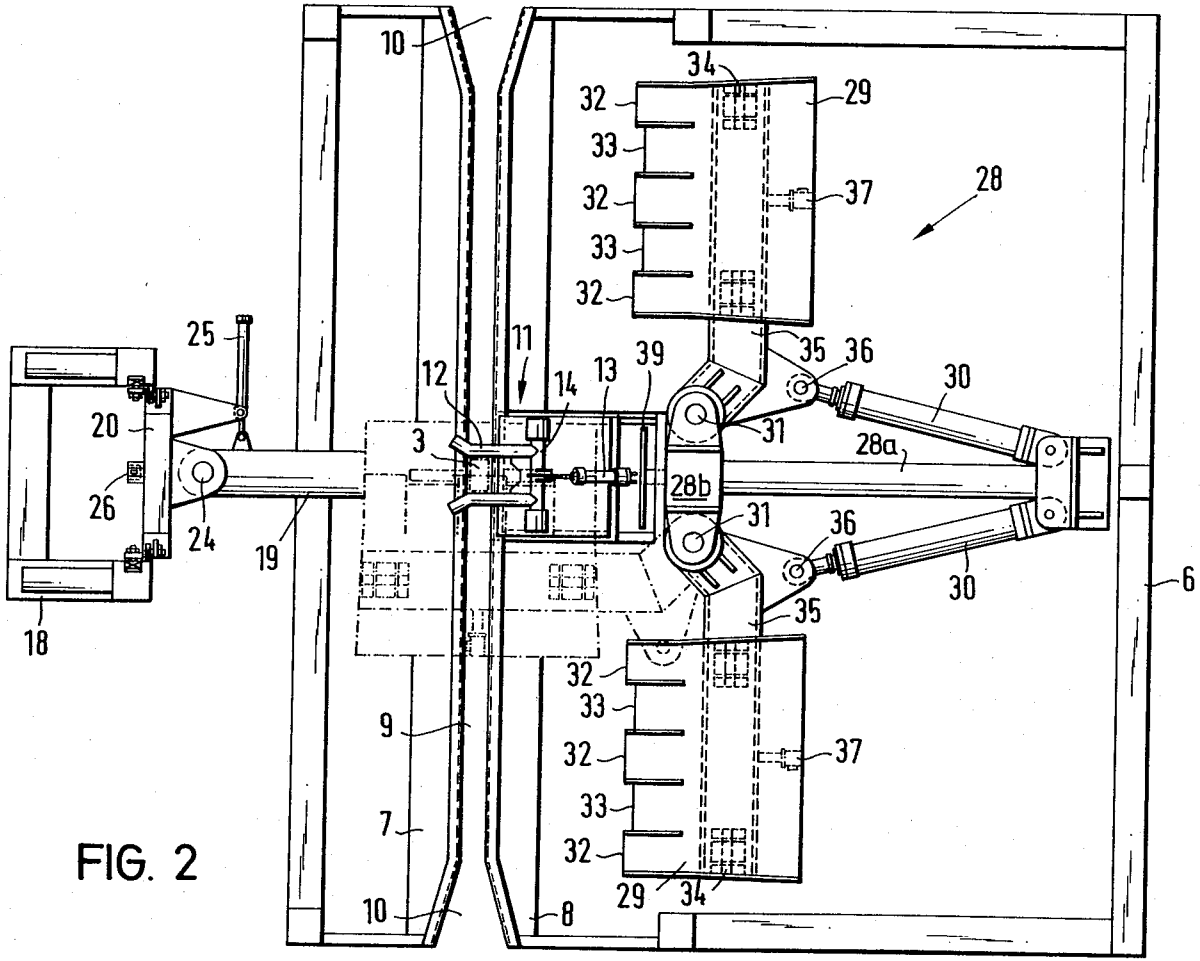
FIG. 2 is a plan view of the cleaning apparatus.

After the incrustations 2 have been separated off from a remnant 1, the blades 29 are swung back into the position shown in FIG. 2. The fork 12 is then swung up into the position shown in dash-dot lines, and the cleaned remnant 1, still mounted on its anode bar 3, is removed from the apparatus by means of the overhead conveyor. Another remnant 1 can then be carried into the cleaning apparatus, and the cleaning process repeated.

A blower 39 is positioned between the blades 29 (see FIG. 2), the blower being effective to blow the aluminium oxide dust formed during the cleaning process into a suction device 40 (see FIG. 1).

I claim:

1. Apparatus for cleaning bar-mounted remnants of carbon blocks, the apparatus comprising a machining station defining a working position, a breaking device for loosening incrustations adhering to the remnants at the working position, and a transport device for moving the individual remnants into the working position, wherein the breaking device includes at least two blades which are displaceable transversely of the direction of movement of the transport device, each of said blades having a cutting edge provided with at least one recess.

2. Cleaning apparatus according to claim 1, further comprising means for moving the remnants successively to the machining station.

3. Cleaning apparatus according to claim 1, wherein the transport device is a lifting device.

4. Cleaning apparatus according to claim 3, wherein the lifting device is a lifting table.

5. Cleaning apparatus according to claim 4, wherein the lifting table is arranged on an arm, the arm being mounted on a stand for vertical displacement relative thereto.

6. Cleaning apparatus according to claim 5, wherein the lifting table is mounted on the arm so as to be pivotable about a horizontal axis.

7. Cleaning apparatus according to claim 5, wherein the arm is mounted on the stand so as to be pivotable about a vertical axis.

8. Cleaning apparatus according to claim 7, further comprising a ram for pivoting the arm relative to the stand.

9. Cleaning apparatus according to claim 4, further comprising a conveyor, the conveyor being positioned below the lifting table for carrying away material broken away from the remnants.

10. Cleaning apparatus according to claim 1, further comprising a retaining device for holding individual remnants in the machining station in alignment with the working position.

11. Cleaning apparatus according to claim 10, wherein the individual remnants have rods, and wherein the retaining device retains and aligns the individual remnants by abutment with said rods.

12. Cleaning apparatus according to claim 11, wherein the retaining device comprises a forked member.

13. Cleaning apparatus according to claim 10, wherein the retaining device is pivotally mounted for movement about a horizontal axis.

14. Cleaning apparatus according to claim 13, further comprising a ram for pivoting the retaining device.

15. Cleaning apparatus according to claim 1, further comprising a limit switch which is arranged to stop the movement of the transport device when an individual remnant is in the working position.

16. Cleaning apparatus according to claim 15, wherein the limit switch is so positioned as to be actuated by nipples associated with the rods of the remnants.

17. Cleaning apparatus according to claim 1, wherein each of the blades is pivotable about an axis which is parallel to the direction of movement of the transport device.

18. Cleaning apparatus according to claim 17, wherein each of the blades is pivotable by means of a ram, the arrangement being such that the blades move in the manner of tongs.

19. Cleaning apparatus according to claim 1, wherein each of the blades is pivotable about a horizontal axis by means of a ram.

20. Cleaning apparatus according to claim 1, wherein each of the blades is of shovel-shaped configuration.

21. Cleaning apparatus according to claim 1, further comprising a blower and a suction device, the blower being positioned in the zone of the breaking device, and the suction device being positioned in the path of dust blown off by the blower.

22. Apparatus for cleaning bar-mounted remnants of carbon blocks, each of the remnants being mounted on nipples provided at the end of a bar, the apparatus comprising a breaking device for loosening incrustations adhering to the remnants, the breaking device including two blades, each of the blades having a cutting edge provided with at least one recess, the blades being movable in such a manner, and the recesses being so positioned, that, in use, the recesses engage around the nipples of said bars.

23. Apparatus for cleaning bar-mounted remnants of carbon blocks, the apparatus comprising: a machining station defining a working position; a transport device for moving individual remnants into the working position; a retaining device for holding individual remnants in the machining station in alignment with the working position, said retaining device being pivotally mounted for movement about a horizontal axis; and a breaking device for loosening incrustations adhering to the remnants at the working position, said breaking device including at least one breaking tool which is displaceable transversely of the direction of movement of the transport device.

* * * * *